US010877409B2

(12) United States Patent
Watatani et al.

(10) Patent No.: US 10,877,409 B2
(45) Date of Patent: Dec. 29, 2020

(54) FIXING DEVICE AND IMAGE FORMING APPARATUS

(71) Applicant: KYOCERA Document Solutions Inc., Osaka (JP)

(72) Inventors: Tomohiro Watatani, Osaka (JP); Masakazu Uehara, Osaka (JP); Hironori Takahashi, Osaka (JP); Yuhiro Sakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/712,090

(22) Filed: Dec. 12, 2019

(65) Prior Publication Data

US 2020/0201218 A1 Jun. 25, 2020

(30) Foreign Application Priority Data

Dec. 21, 2018 (JP) ..... 2018-239761

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01)

(58) Field of Classification Search
CPC ..... G03G 15/2053; G03G 2215/2035; G03G 15/2064; G03G 15/2017; G03G 15/2039
See application file for complete search history.

(56) References Cited

U.S. PATENT DOCUMENTS

2012/0275832 A1* 11/2012 Suzuki ..... G03G 15/2053 399/329
2013/0302046 A1* 11/2013 Monde ..... G03G 15/2053 399/33
2014/0086649 A1* 3/2014 Hazeyama ..... G03G 15/2017 399/329
2016/0327900 A1* 11/2016 Tanaka ..... G03G 21/1647
2016/0378027 A1* 12/2016 Sawada ..... G03G 15/2053 399/329
2020/0201219 A1* 6/2020 Uehara ..... G03G 15/2053

FOREIGN PATENT DOCUMENTS

JP 2017097143 A 6/2017

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

In a fixing device, a heating section is disposed opposite to an inner circumferential surface of a fixing belt. The heating section includes a heater, a heater holding member, a heat sensitive body disposed opposite to the heater on the heater holding member, a covering member disposed opposite to the heater holding member with the heat sensitive body therebetween, and an urging member disposed between the covering member and the heat sensitive body and urging the heat sensitive body in an urging direction. First and second restricting portions of the heater holding member restrict movement of the covering member in a direction opposite to the urging direction. In a state in which first and second engaging portions of the covering member respectively engage with the first and second restricting portions in a slidable manner in the urging direction, the urging member urges the heat sensitive body in the urging direction.

10 Claims, 8 Drawing Sheets

FIXING DEVICE AND IMAGE FORMING APPARATUS

INCORPORATION BY REFERENCE

The present application claims priority under 35 U.S.C. § 119 to Japanese Patent Application No. 2018-239761, filed on Dec. 21, 2018. The contents of this application are incorporated herein by reference in their entirety.

BACKGROUND

The present disclosure relates to a fixing device and an image forming apparatus.

A fixing device using a heating film has been known to be included in an electrographic image forming apparatus. One of such fixing devices includes a fixing assembly and a pressure roller that presses against the fixing assembly to form a fixing nip part. The fixing assembly includes a tubular fixing film, a heater in contact with an inner surface of the fixing film, a heat insulating holder that holds the heater, a metal frame stay that presses the heat insulating holder against the pressure roller, a thermistor, and a heat conduction member. The thermistor is provided on the heat insulating holder and in contact with the heat conduction member at a specific pressure through a through hole in the heat insulating holder. The thermal transmission member is held by the heat insulating holder between the heater and the heat insulating holder.

Each of the heater, the heat insulating holder, the metal frame stay, and the heat conduction member extends in a direction perpendicular to a recording medium conveyance direction. When the metal stay is attached to the heat insulating holder, the load of the metal stay is transmitted to the entirety of the heat insulating holder in the longitudinal direction of the heat insulating holder via pressure springs disposed at the opposite ends of the metal stay in the longitudinal direction of the metal stay. Heat accumulated in a paper non-passing area of the fixing nip part is transmitted to the thermistor via the heat conduction member. In the fixing device, an excessive increase in temperature of the paper non-passing area can be suppressed.

SUMMARY

A fixing device according to an aspect of the present disclosure includes a fixing belt and a heating section. The heating section is disposed opposite to an inner circumferential surface of the fixing belt. The heater includes: a heater that heats the fixing belt; a heater holding member that holds the heater; a heat sensitive body disposed on the heater holding member so as to be located opposite to the heater; a covering member disposed opposite to the heater holding member with the heat sensitive body therebetween; and an urging member that is disposed between the covering member and the heat sensitive body and that urges the heat sensitive body in an urging direction from the heat sensitive body toward the heater. The heater holding member includes a first restricting portion and a second restricting portion. Each of the first restricting portion and the second restricting portion restricts movement of the covering member in a direction opposite to the urging direction. The covering member includes a first engaging portion engaging with the first restricting portion and a second engaging portion engaging with the second restricting portion. In a state in which the first engaging portion and the second engaging portion respectively engage with the first restricting portion and the second restricting portion in a slidable manner in the urging direction, the urging member urges the heat sensitive body in the urging direction.

According to another aspect of the present disclosure, an image forming apparatus includes the above-described fixing device and an image forming section. The image forming section forms a toner image on a sheet. The fixing device fixes the toner image to the sheet.

DETAILED DESCRIPTION

Figure 1:
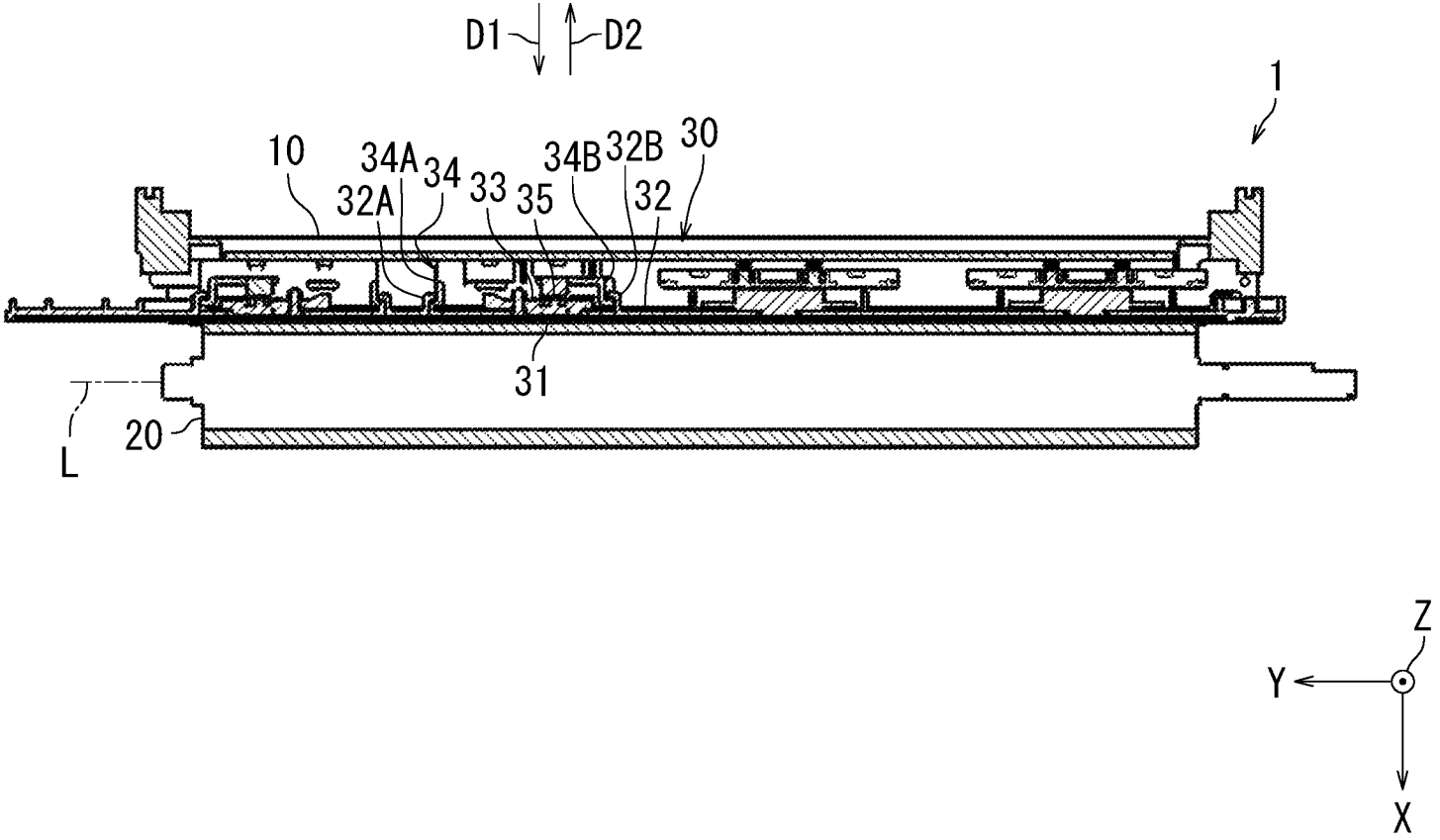
FIG. 1 is a cross-sectional view of a fixing device according to an embodiment of the present disclosure.

The following describes embodiments of the present disclosure with reference to the accompanying drawings. Elements that are the same or equivalent are indicated by the same reference signs in the drawings, and description thereof is not repeated. In a three-dimensional rectangular coordinate system in the following embodiments, an X axis and a Y axis are parallel to a horizontal plane and a Z axis is parallel to a vertical direction. A direction of the Y axis is an example of a direction parallel to a "rotation axis" of a "pressure member" in the present disclosure.

An embodiment of a fixing device 1 according to the present disclosure will be described with reference to FIG. 1. FIG. 1 is a cross-sectional view of the fixing device 1. As illustrated in FIG. 1, the fixing device 1 includes a fixing belt 10, a pressure member 20, and a heating section 30. The fixing device 1 is included for example in an electrographic image forming apparatus.

The fixing belt 10 is an endless belt. The pressure member 20 applies pressure to the fixing belt 10 while in contact with an outer circumferential surface of the fixing belt 10, and rotates about a rotation axis L of the pressure member 20. The pressure member 20 is for example a pressure roller.

The heating section 30 is disposed opposite to an inner circumferential surface of the fixing belt 10. The heating section 30 includes a heater 31, a heater holding member 32, at least one heat sensitive body 33, at least one covering member 34, and at least one urging member 35.

The heater 31 heats the fixing belt 10. The heater 31 is planar in shape or in a slender thin plate-like shape. The heater 31 extends in a direction parallel to the rotation axis L of the pressure member 20. The heater 31 is for example a ceramic heater and includes a ceramic substrate and a resistance heating element. The heater 31 has a thickness of 1 mm, for example.

The heat sensitive body 33 is located opposite to the heater 31. The heat sensitive body 33 is disposed on the heater holding member 32. The heat sensitive body 33 senses heat of the heater 31. The heat sensitive body 33 detects a temperature of the heater 31 in the present embodiment.

The urging member 35 is disposed between the covering member 34 and the heat sensitive body 33. The urging member 35 is for example a coil spring. The urging member 35 is for example in a cylindrical shape, a conical shape, or a barrel shape. The urging member 35 urges the heat sensitive body 33 in an urging direction D1. The urging direction D1 is a direction from the heat sensitive body 33 toward the heater 31.

The heater holding member 32 holes the heater 31. The heater holding member 32 is disposed opposite to the fixing belt 10 with the heater 31 therebetween. The heater holding member 32 is for example made from a heat-resistant resin. The heater holding member 32 extends in a direction parallel to the rotation axis L of the pressure member 20. The heater holding member 32 includes a first restricting portion 32A and a second restricting portion 32B. Each of the first restricting portion 32A and the second restricting portion 32B restricts movement of the covering member 34 in a direction D2 opposite to the urging direction D1.

The covering member 34 is disposed opposite to the heater holding member with the heat sensitive body 33 therebetween. The covering member 34 includes a first engaging portion 34A and a second engaging portion 34B. The first engaging portion 34A engages with the first restricting portion 32A. The first engaging portion 34A in a state of engaging with the first restricting portion 32A is slidable on the first restricting portion 32A in the urging direction D1. The second engaging portion 34B engages with the second restricting portion 32B. The second engaging portion 34B in a state of engaging with the second restricting portion 32B is slidable on the second restricting portion 32B in the urging direction D1. In the following, a state in which the first engaging portion 34A engages with the first restricting portion 32A in a slidable manner in the urging direction D1 and the second engaging portion 34B engages with the second restricting portion 32B in a slidable manner in the urging direction D1 may be referred to simply as an "engaging state". As a result of the first engaging portion 34A and the second engaging portion 34B being slidable in the engaging state, a user can push the covering member 34 to a further extent in the urging direction D1.

The urging member 35 in the engaging state urges the heat sensitive body 33 in the urging direction D1. As a result of the urging member 35 in the engaging state urging the heat sensitive body 33, the heater holding member 32 provisionally secures the covering member 34, the urging member 35, and the heat sensitive body 33 on the heater 31 with the heat sensitive body 33 in contact with the heater 31. Thus, such a simple configuration can inhibit displacement of the heat sensitive body 33 without need for the user to keep supporting the heat sensitive body 33 using the fingers in assembling the heating section 30. Thus, the number of components can be reduced and convenience in assembly can be improved.

Figure 2:
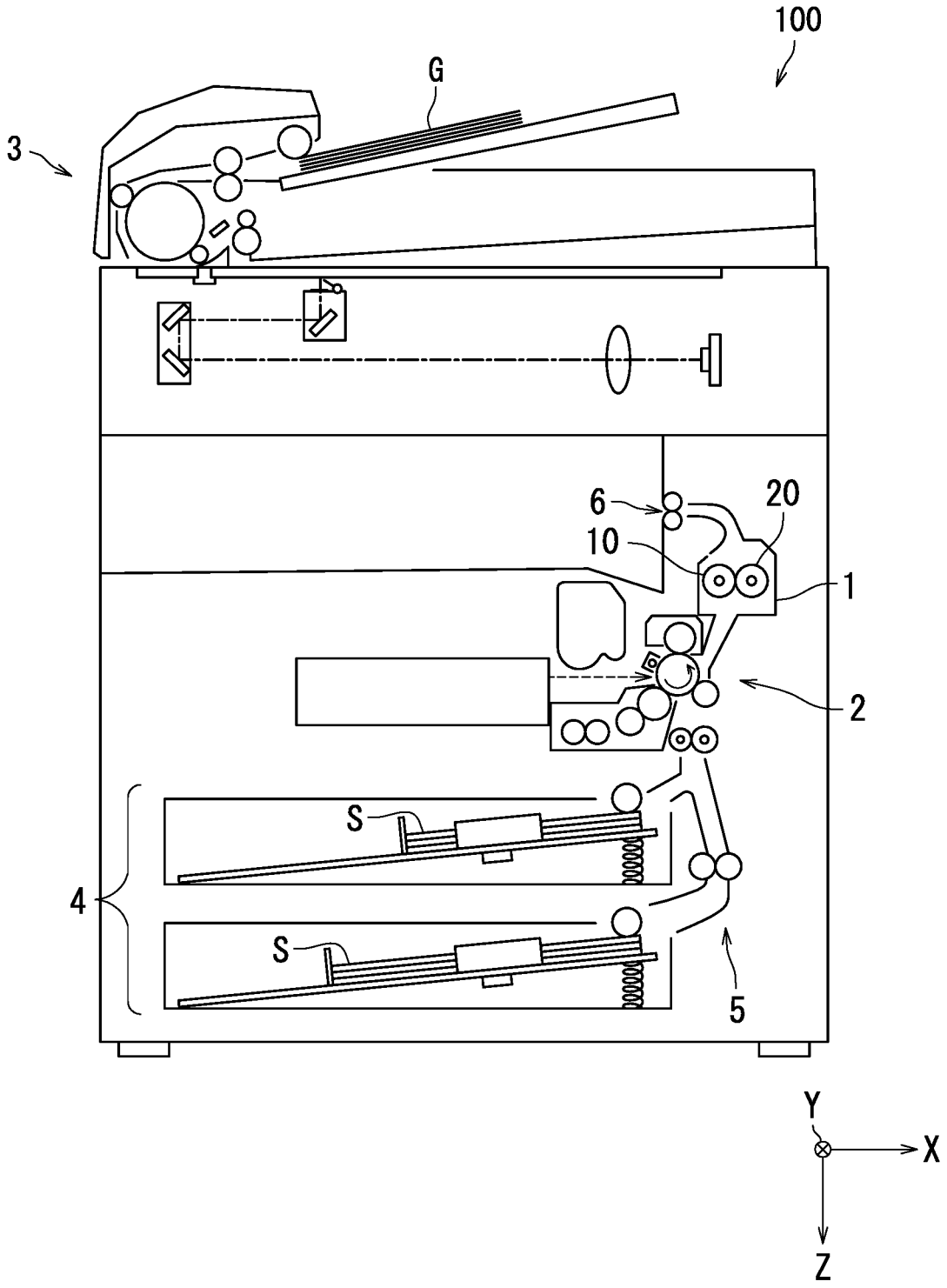
FIG. 2 is a diagram illustrating an image forming apparatus including the fixing device.

Operation and configuration of an image forming apparatus 100 including the fixing device 1 will be described next with reference to FIG. 2. FIG. 2 is a diagram illustrating the image forming apparatus 100. The image forming apparatus 100 is for example a copier, a printer, a facsimile machine, or a multifunction peripheral that implements functions of the aforementioned machines. The following describes an embodiment in which the image forming apparatus 100 is a monochrome multifunction peripheral.

As illustrated in FIG. 2, the image forming apparatus 100 includes a reading section 3, a feeding section 4, a conveyance section 5, an image forming section 2, the fixing device 1, and an ejection section 6.

The reading section 3 reads an image of a document G. The reading section 3 generates image data based on the read image. The feeding section 4 accommodates a plurality of sheets S and feeds the sheets S to the conveyance section 5 one at a time. Each of the sheets S is for example a sheet of paper or a sheet made from a synthetic resin. The conveyance section 5 includes a plurality of conveyance roller pairs and conveys the sheet S to the image forming section 2.

The image forming section 2 electrographically forms a toner image on the sheet S. Specifically, the image forming section 2 includes a photosensitive drum, a charger, a light exposure device, a development device, a replenishment device, a transfer device, a cleaner, and a static eliminator. The toner image represents for example the image of the document G. The fixing device 1 fixes the toner image to the sheet S by applying heat and pressure to the toner image. The conveyance section 5 conveys the sheet S with the toner image fixed thereto to the ejection section 6. The ejection section 6 ejects the sheet S out of the image forming apparatus 100.

Figure 3A:
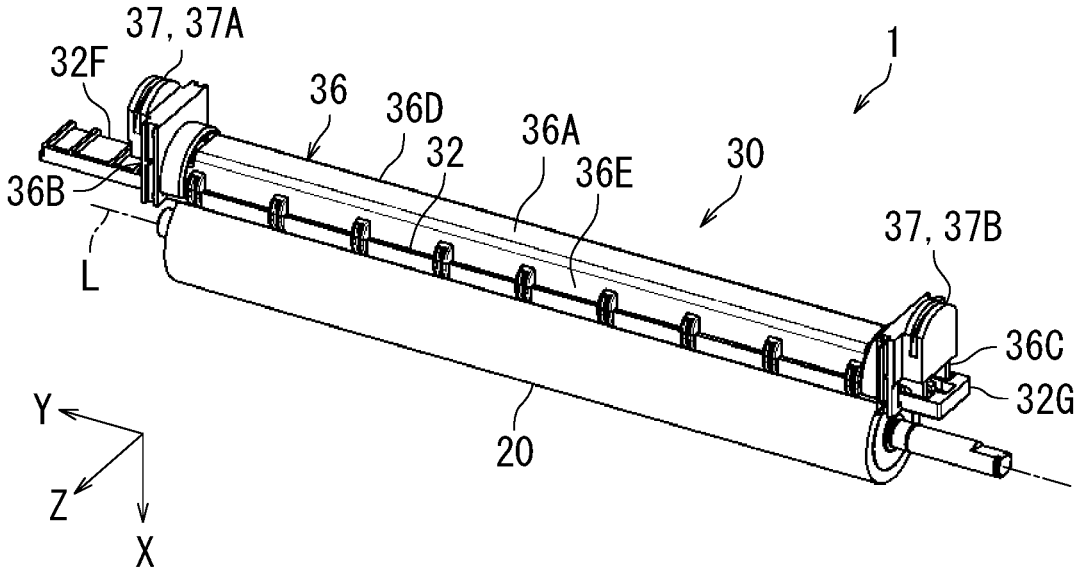
FIG. 3A is a perspective view of the fixing device.
Figure 3B:
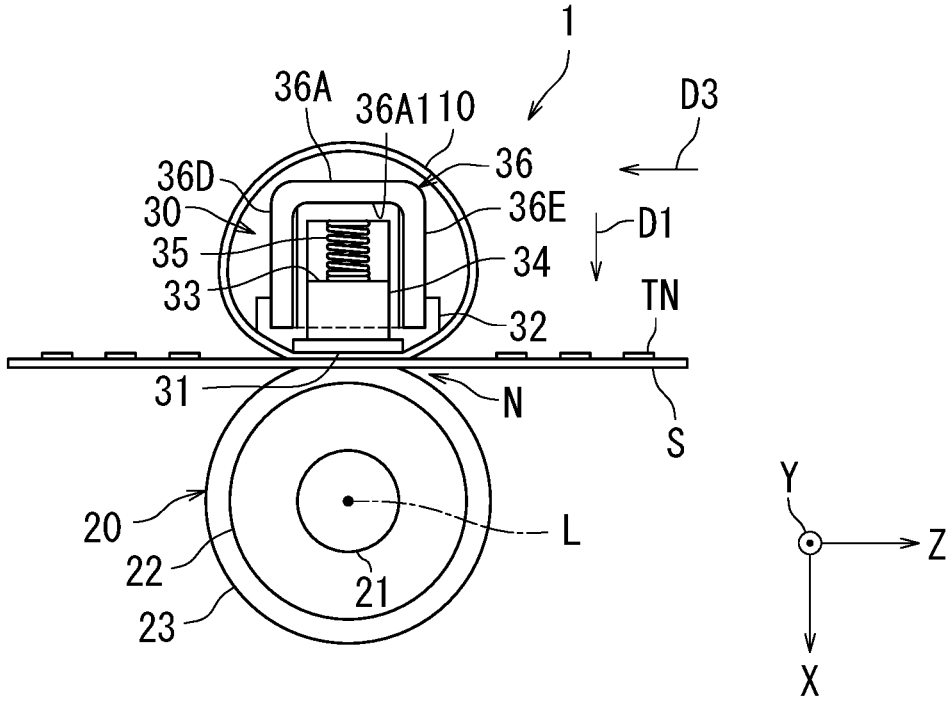
FIG. 3B is a diagram illustrating the fixing device.

Each configuration of the heating section 30 and the fixing device 1 will be described next in detail with reference to FIGS. 3A and 3B. FIG. 3A is a perspective view of the fixing device 1. Note that FIG. 3A illustrates a state in which the fixing belt 10 is removed from the fixing device 1. FIG. 3B is a diagram illustrating the fixing device 1. Note that FIG. 3B is simplified for the sake of easy viewing of the heating section 30.

As illustrated in FIG. 3A, preferably, the heating section 30 further includes a reinforcing member 36 in addition to the heater 31, the heater holding member 32, the heat sensitive body 33, the covering member 34, and the urging member 35 described with reference to FIG. 1. The reinforcing member 36 reinforces the heater holding member 32. The reinforcing member 36 is for example a slim and long metal stay. The reinforcing member 36 has two ends in a longitudinal direction thereof, one of which is a first end 36B and the other of which is a second end 36C.

The reinforcing member 36 includes a first side plate 36D, a second side plate 36E, and a top plate 36A. The first and second side plates 36D and 36E each stand from the top plate 36A. The first side plate 36D is disposed opposite to the second side plate 36E with the top plate 36A therebetween. The reinforcing member 36 is overlaid with the heater holding member 32 in a longitudinal direction of the heater holding member 32 at a location opposite to the heater holding member 32. The reinforcing member 36 extends in a direction parallel to the rotation axis L of the pressure member 20.

One end of the two ends of the heater holding member 32 in the longitudinal direction thereof is referred to as a third end 32F. The other end thereof is referred to as a fourth end 32G. The third end 32F functions as a connector receiving part. The connector receiving part is capable of receiving a connector of a main body of the image forming apparatus 100. The third end 32F is located opposite to the first end 36B of the reinforcing member 36. The fourth end 32G is located opposite to the second end 36C of the reinforcing member 36.

The heat sensitive body 33 illustrated in FIG. 3B includes at least one of a thermal fuse, a thermostat, and a thermistor. The thermal fuse is a protection element such as a one-shot thermostat. The thermal fuse shuts off electric power supply to the heater 31 when the temperature of the heater 31 is equal to or higher than a first threshold. In particular, once the thermal fuse shuts off the electric power supply according to the temperature of the heater 31, the electric power supply is not resumed. Therefore, accuracy in suspending heating of the fixing belt 10 by the heater 31 when the temperature of the heater 31 is excessively increased can be improved.

The thermostat shuts off the electric power supply to the heater 31 when the temperature of the heater 31 is equal to or higher than a second threshold, and causes the electric power supply to the heater 31 to be resumed when the temperature of the heater 31 becomes lower than the second threshold. In the above configuration, the heater 31 for heating the fixing belt 10 can be turned on and off with delicate accuracy corresponding to temperature change of the heater 31.

The thermistor is a semiconductor element for measuring the temperature of the heater 31. The image forming apparatus 100 controls the heater 31 according to the temperature measured by the thermistor. As a result of the heat sensitive body 33 being a thermistor, accuracy in controlling the temperature of the heater 31 can be improved. Note that the following embodiments describe a case in which the heat sensitive body 33 is a thermistor.

The reinforcing member 36 is in contact with the covering member 34. Specifically, the reinforcing member 36 has substantially an inverted U-shape in cross section as viewed in a direction parallel to the rotation axis L. The top plate 36A has a contact surface 36A1. The contact surface 36A1 is in contact with the covering member 34. The reinforcing member 36 in contact with the covering member 34 is secured at a location opposite to the heater holding member 32 with the covering member 34 therebetween. In the following, a "state in which the reinforcing member 36 and the heater holding member 32 are secured at a location opposite to each other" may be referred to as a "reinforcing member opposed state".

In the reinforcing member opposed state, the urging member 35 urges the heat sensitive body 33 in the urging direction D1 in a further extent. A pressure by an urging force of the urging member 35 in the reinforcing member opposed state is greater than a pressure by an urging force of the urging member 35 in the engaging state. That is, when the heating section 30 transitions from the engaging state to the reinforcing member opposed state, the covering member 34 is pushed in a further extent in the urging direction D1. The heat sensitive body 33 is accordingly in close contact with the heater 31. In the above configuration, an ideal load of the heat sensitive body 33 can be caused to act on the heater 31 with a simple configuration. Thus, the number of components can be reduced and a load of the heat sensitive body 33 on the heater 31 can be stabilized with a simple configuration.

Preferably, the contact surface 36A1 of the top plate 36A is a planar surface. As a result of the contact surface 36A1 being a planar surface, inclination of the contact surface 36A1 relative to the covering member 34 can be prevented in the contact surface 36A1 coming into contact with the covering member 34. Thus, the covering member 34 is prevented from being inclined in assembly. In turn, convenience in assembly can be further improved.

The fixing device 1 further includes a belt holding member 37 and an unillustrated drive mechanism in addition to the fixing belt 10, the pressure member 20, and the heating section 30 described with reference to FIG. 1.

The fixing belt 10 is a flexible endless belt in a substantial tubular shape. The fixing belt 10 includes a plurality of layers. The fixing belt 10 includes for example a polyimide layer and a release layer disposed on the polyimide layer. The release layer is for example a heat-resistant film made from a fluororesin.

The pressure member 20 is columnar in shape. The pressure member 20 includes a columnar core bar 21, a cylindrical elastic layer 22, and a release layer 23. The elastic layer 22 is disposed around the core bar 21, and the release layer 23 covers a surface of the elastic layer 22. The core bar 21 is for example made from stainless or aluminum. The elastic layer 22 is elastic and is made from for example a silicone rubber. The release layer 23 is made from for example a fluororesin.

The pressure member 20 is pressed against the heater 31 with the fixing belt 10 therebetween, thereby being in pressure contact with the fixing belt 10. A nip part N is formed at a location where the pressure member 20 is in pressure contact with the fixing belt 10. When the pressure member 20 is driven and rotate, the fixing belt 10 follows the rotation of the pressure member 20 to be rotated. When the sheet S passes through the nip part N through conveyance of the sheet S in a sheet conveyance direction D3, the toner image TN is melted and fixed to the sheet S.

The belt holding member 37 holds two ends of the fixing belt 10 in a width direction of the fixing belt 10. Specifically, the belt holding member 37 includes a first belt holding portion 37A and a second belt holding portion 37B. The first belt holding portion 37A holds an end of the fixing belt 10 that is located in correspondence with (close to) the first end 36B of the reinforcing member 36. The second belt holding portion 37B holds an end of the fixing belt 10 that is located in correspondence with (close to) the second end 36C of the reinforcing member 36.

Furthermore, the belt holding member 37 secures the reinforcing member 36 to the heater holding member 32. Specifically, the belt holding member 37 is fitted to the reinforcing member 36 and the heater holding member 32 in the state in which the reinforcing member 36 is located opposite to the heater holding member 32. The first belt holding portion 37A secures the first end 36B of the reinforcing member 36 to the third end 32F of the heater holding member 32. The second belt holding p 37B secures the second end 36C of the reinforcing member 36 to the fourth end 32G of the heater holding member 32.

The drive mechanism drives and rotates the pressure member 20. The drive mechanism includes for example a drive motor and a gear. The drive mechanism is connected to one of two ends of the core bar 21 of the pressure member 20 in a longitudinal direction of the pressure member 20. The drive mechanism is disposed for example close to the second end 36C of the first and second ends 36B and 36C of the reinforcing member 36.

Figure 4A:
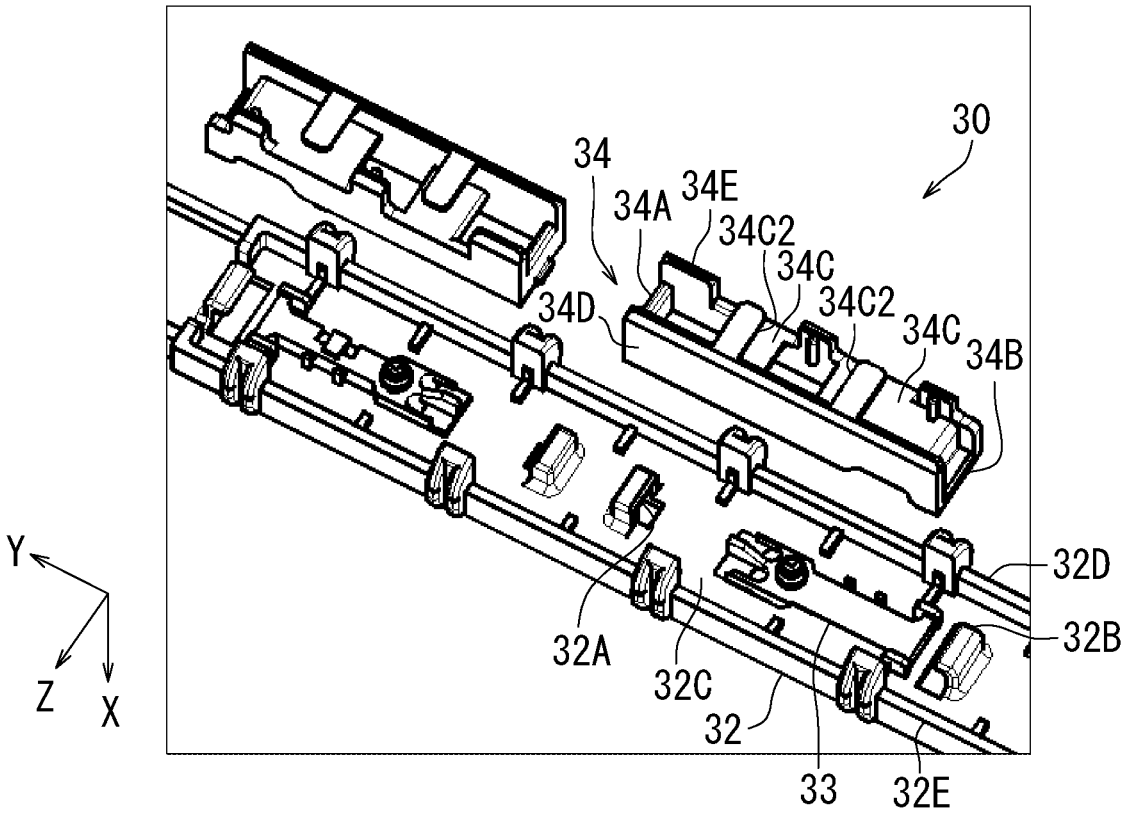
FIG. 4A is a perspective view of a heating section of the fixing device.
Figure 4B:
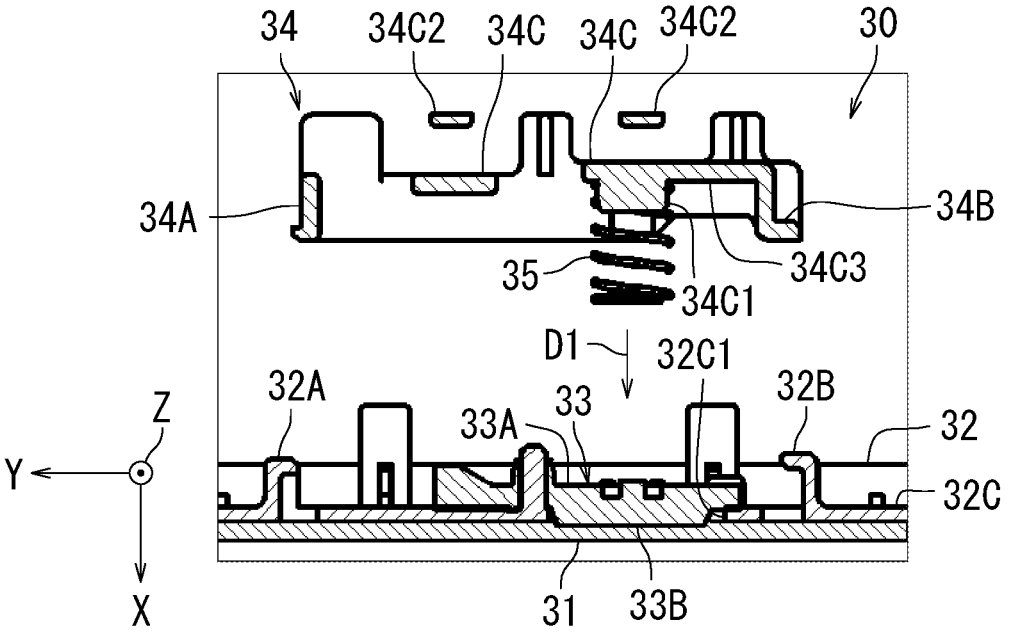
FIG. 4B is a cross-sectional view of the heating section.
Figure 5A:
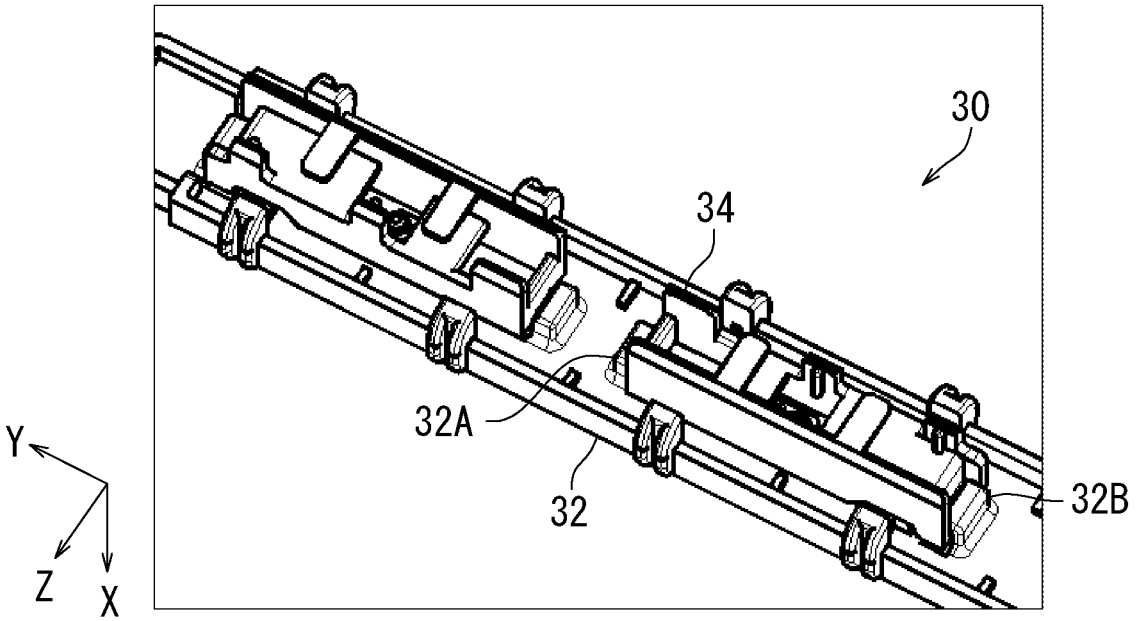
FIG. 5A is a perspective view of the heating section.
Figure 5B:
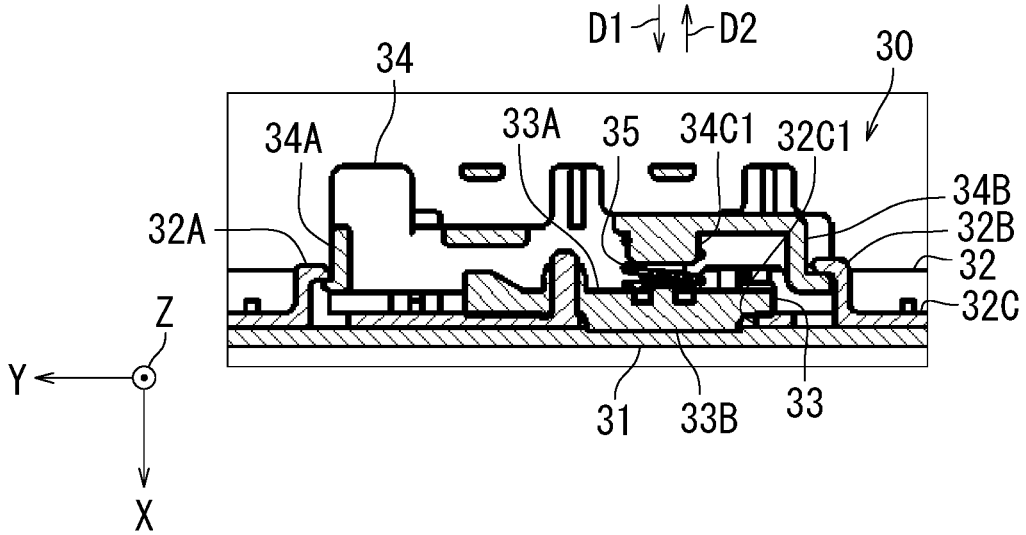
FIG. 5B is across-sectional view of the heating section.

Detailed description of the engaging state and the configuration of the heating section 30 will continue with reference to FIGS. 4A to 5B. FIGS. 4A and 5A are perspective views of the heating section 30. FIGS. 4B and 5B are cross-sectional views of the heating section 30. FIG. 4A corresponds to FIG. 4B. FIG. 5A corresponds to FIG. 5B. FIGS. 4A and 4B each illustrate a state in which the covering member 34 is detached and separate from the heater holding member 32.

As illustrated in FIGS. 4A and 4B, the covering member 34 is for example a heat-resistant box-shaped member made from a resin. The covering member 34 extends in the longitudinal direction of the heater holding member 32. The covering member 34 has a shape corresponding to the shape of the heat sensitive body 33. Specifically, the covering member 34 includes a top wall 34C, a first side wall 34D, and a second side wall 34E in addition to the first engaging portion 34A and the second engaging portion 34B described with reference to FIG. 1.

The top wall 34C includes a protrusion 34C1, a plurality of arms 34C2, and an opposing surface 34C3. The opposing surface 34C3 faces the heat sensitive body 33. The protrusion 34C1 protrudes in the urging direction D1. That is, the protrusion 34C1 protrudes from the opposing surface 34C3 toward the heat sensitive body 33. The protrusion 34C1 has a shape for example corresponding to the inner diameter of the coil spring.

Preferably, the urging member 35 is secured to the protrusion 34C1. Posture stability of the urging member 35 can be improved in the urging member 35 urging the heat sensitive body 33 against the heater 31 in the reinforcing member opposed state. Accordingly, the urging member 35 can be prevented from being buckled. Thus, displacement of the urging member 35 relative to the heat sensitive body 33 can be inhibited and convenience in assembly can be further increased.

The arms 34C2 each protrude for example from the first side wall 34D in parallel to the opposing surface 34C3. The arms 34C2 hold for example various wirings.

The first side wall 34D and the second side wall 34E are disposed opposite to each other with the top wall 34C therebetween. The first side wall 34D and the second side wall 34E extend in the longitudinal direction of the heater holding member 32.

The first engaging portion 34A and the second engaging portion 34B are each in an L shape in cross section. Specifically, the first engaging portion 34A connects the first side wall 34D to the second side wall 34E at one of the two ends in the longitudinal direction of the heater holding member 32. The second engaging portion 34B connects the first side wall 34D to the second side wall 34E at the other end thereof. The first engaging portion 34A and the second engaging portion 34B are disposed opposite to each other with the top wall 34C therebetween. The first engaging portion 34A has a shape corresponding to the shape of the first restricting portion 32A of the heater holding member 32. The second engaging portion 34B has a shape corresponding to the shape of the second restricting portion 32B of the heater holding member 32. For example, each of the first engaging portion 34A and the second engaging portion 34B has a hook-like shape such as a substantial L shape in cross section as viewed in a direction parallel to a width direction of the heater holding member 32 and perpendicular to the rotation axis L.

The heater holding member 32 includes a bottom wall 32C, a third side wall 32D, and a fourth side wall 32E in addition to the first restricting portion 32A and the second restricting portion 32B described with reference to FIG. 1. The third side wall 32D and the fourth side wall 32E each stand from the bottom wall 32C. The third side wall 32D is disposed opposite to the fourth side wall 32E with the bottom wall 32C therebetween.

The first restricting portion 32A and the second restricting portion 32B each protrude in an inverted L shape in cross section from the heater holding member 32. Specifically, the first restricting portion 32A and the second restricting portion 32B are each disposed on the bottom wall 32C. The first restricting portion 32A has a shape corresponding to the shape of the first engaging portion 34A of the covering member 34. The second restricting portion 32B has a shape corresponding to the shape of the second engaging portion 34B of the covering member 34. For example, the first restricting portion 32A and the second restricting portion 32B each have a hook-like shape such as a substantial inverted L shape in cross section as viewed in a direction along a plane parallel to the bottom wall 32C and perpendicular to the rotation axis L. The first restricting portion 32A is located opposite to the second restricting portion 32B with the heat sensitive body 33 therebetween.

The heater holding member 32 has an opening 32C1. The opening 32C1 has a shape corresponding to the shape of the heat sensitive body 33, that is, the shape of a bottom portion 33B of the heat sensitive body 33, for example. The opening 32C1 is a rectangular in shape, for example.

The heat sensitive body 33 includes a main body portion 33A and the bottom portion 33B. A portion of the heat sensitive body 33 is inserted in the opening 32C1 of the bottom wall 32C to be adjacent to the heater 31. The portion of the heat sensitive body 33 is for example the bottom portion 33B. The bottom portion 33B protrudes from the main body portion 33A in the urging direction D1. The bottom portion 33B is inserted in the opening 32C1 of the heater holding member 32.

FIGS. 5A and 5B illustrates the engaging state. As illustrated in FIGS. 5A and 5B, the covering member 34 is mounted on the heater holding member 32 for example in a snap-fit manner.

Specifically, the first engaging portion 34A and the first restricting portion 32A engage with each other. That is, a tip end in a hook-like shape of the first engaging portion 34A is in contact with a tip end in a hook-like shape of the first restricting portion 32A on a plane parallel to the bottom wall 32C. The first restricting portion 32A restricts movement of the first engaging portion 34A in the direction D2 opposite to the urging direction D1. The first engaging portion 34A is slidable in the urging direction D1 on the first restricting portion 32A. A distance in which the first engaging portion 34A is slidable is 1 mm, for example.

Furthermore, the second engaging portion 34B and the second restricting portion 32B engage with each other. That is, a tip end in a hook-like shape of the second engaging portion 34B is in contact with a tip end in a hook-like shape of the second restricting portion 32B on a plane parallel to the bottom wall 32C. The second restricting portion 32B restricts movement of the second engaging portion 34B in the direction D2 opposite to the urging direction D1. The second engaging portion 34B is slidable in the urging direction D1 on the second restricting portion 32B. A distance in which the second engaging portion 34B is slidable is 1 mm, for example.

The protrusion 34C1 is preferably disposed opposite to the heater 31 with the urging member 35 and the heat sensitive body 33 therebetween in a state in which the bottom portion 33B of the heat sensitive body 33 is fitted in the opening 32C1. Specifically, the urging member 35 is in contact with the main body 33A of the heat sensitive body 33 above the opening 32C1 of the bottom wall 32C. The urging member 35 urges the heat sensitive body 33 in the urging direction D1. In the above configuration, the bottom portion 33B of the heat sensitive body 33 can be pressed against the heater 31 in an effective manner. Thus, convenience in assembly and accuracy in sensing the heat of the heater 31 can be improved.

As has been described with reference to FIGS. 4A to 5B, each of the first restricting portion 32A and the second restricting portion 32B protrudes in an inverted L shape in cross section from the heater holding member 32. The first engaging portion 34A and the second engaging portion 34B are each in an L shape in cross section. Accordingly, the covering member 34 can be provisionally attached to the heater holding member 32 with a simple configuration such as in a snap-fit manner. Thus, the number of components can be reduced and convenience in assembly can be improved.

Figure 6A:
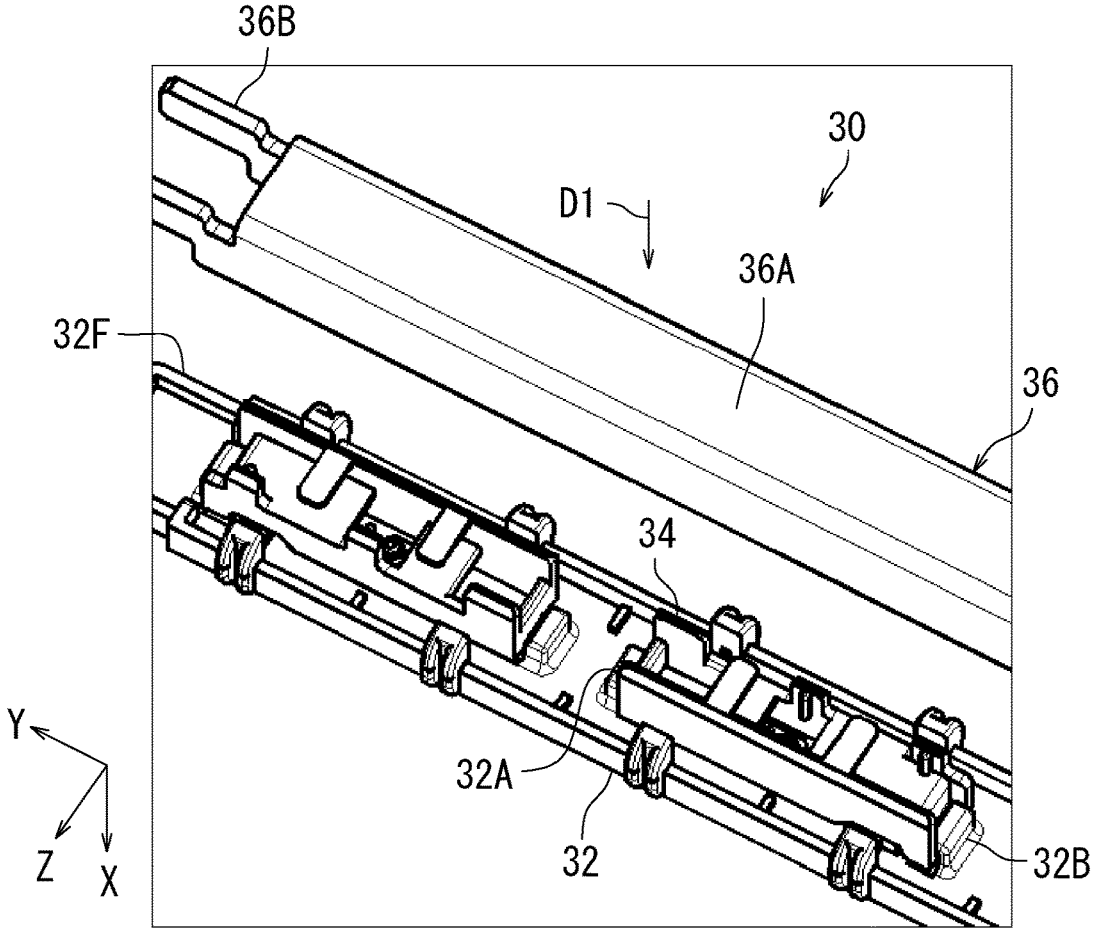
FIG. 6A is a perspective view of the heating section.
Figure 6B:
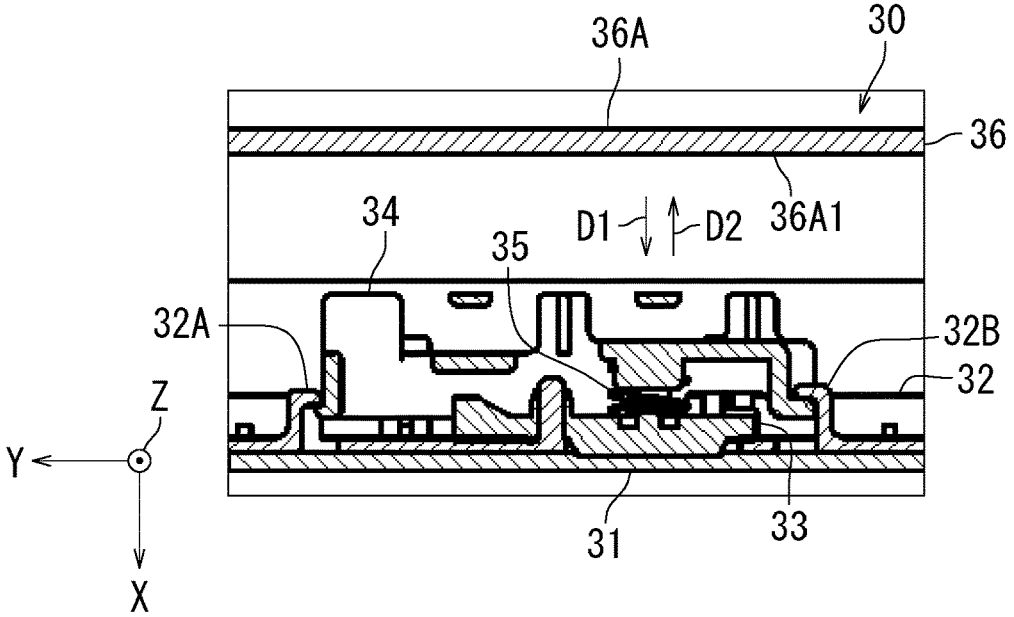
FIG. 6B is a cross-sectional view of the heating section.
Figure 7A:
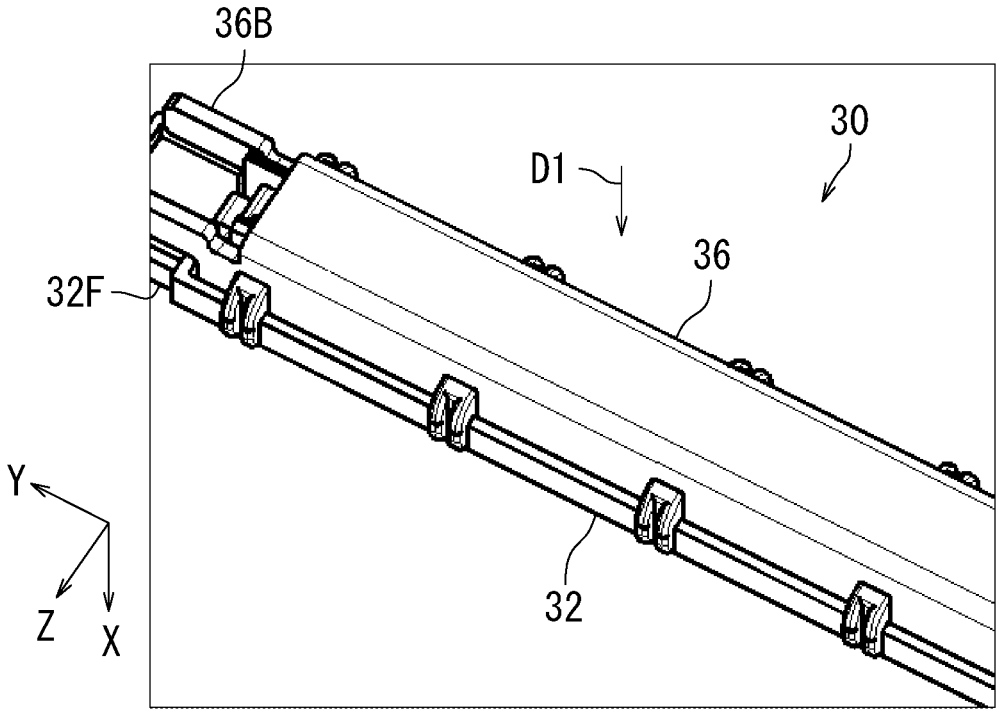
FIG. 7A is a perspective view of the heating section.
Figure 7B:
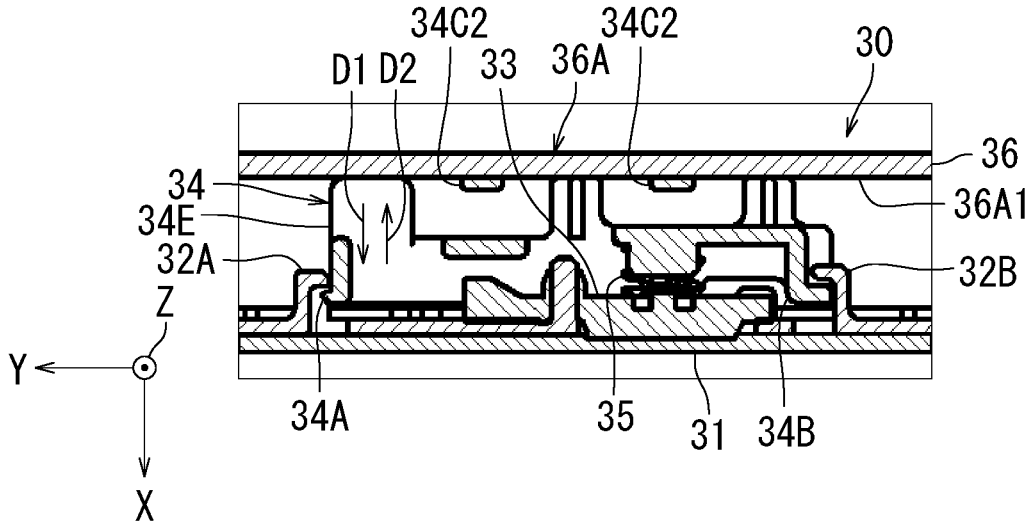
FIG. 7B is a cross-sectional view of the heating section.

Detailed description of the reinforcing member opposed state will continue with reference to FIGS. 6A to 7B. FIGS. 6A and 7A are perspective views of the heating section 30. FIGS. 6B and 7B are cross-sectional views of the heating section 30. FIG. 6A corresponds to FIG. 6B. FIG. 7A corresponds to FIG. 7B. FIGS. 6A and 6B each illustrate a state in which the reinforcing member 36 is detached and separate from the heater holding member 32.

As illustrated in FIGS. 6A and 6B, the reinforcing member 36 extends in the longitudinal direction of the heater holding member 32. The reinforcing member 36 is mounted on the heater holding member 32 in parallel to the heater holding member 32 to cover the covering member 34 that is in the engaging stated.

FIGS. 7A and 7B illustrate the reinforcing member opposed state. As illustrated in FIGS. 7A and 7B, the reinforcing member 36 is mounted on the heater holding member 32 in parallel to the heater holding member 32. The reinforcing member 36 is secured to the heater holding member 32 while in contact with the covering member 34 at a location opposite to the heater holding member 32 with the covering member 34 therebetween. The contact surface 36A1 of the reinforcing member 36 is in contact with an end of the covering member 34 on a side in the direction D2 opposite to the urging direction D1. For example, the contact surface 36A1 is in contact with the first side wall 34D, the second side wall 34E, and the arms 34C2 of the covering member 34.

As a result of the reinforcing member 36 coming into contact with the covering member 34, the urging member 35 urges the heat sensitive body 33 in the urging direction D1 to a further extent. The first engaging portion 34A slides in the urging direction D1 on the first restricting portion 32A to approach the heater 31. The second engaging portion 34B slides in the urging direction D1 on the second restricting portion 32B to approach the heater 31. In other words, the reinforcing member 36 pushes the covering member 34 and the heating section 30 transitions from the engaging state to the reinforcing member opposed state. In the reinforcing member opposed state, engagement between the first engaging portion 34A and the first restricting portion 32A is released. Similarly, engagement between the second engaging portion 34B and the second restricting portion 32B is released in the reinforcing member opposed state.

Figure 8:
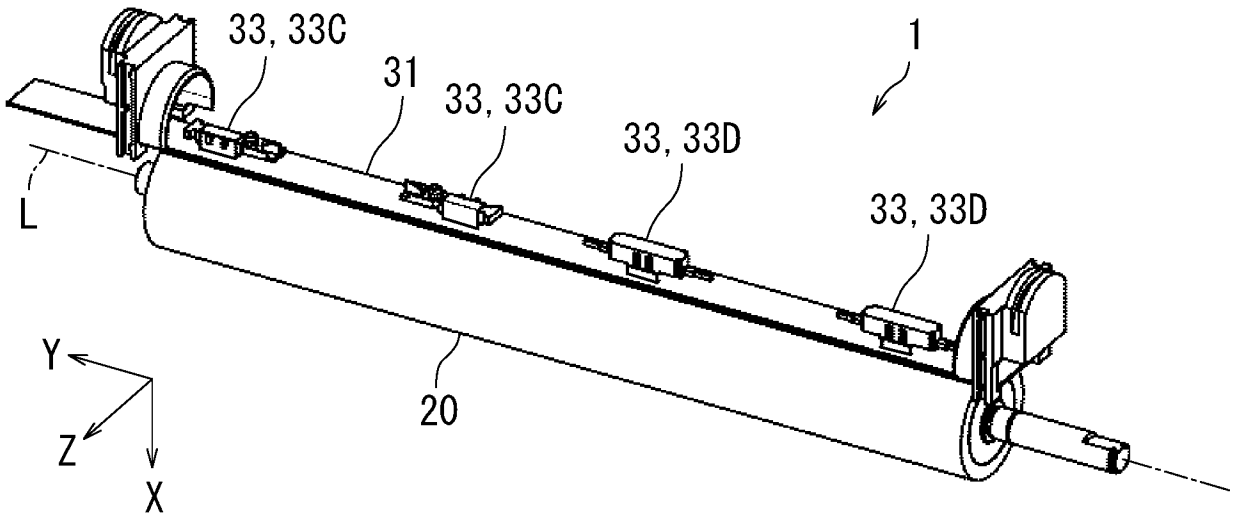
FIG. 8 is a perspective view of the fixing device.

Note that the number of heat sensitive bodies 33 may be plural as illustrated in FIG. 8. FIG. 8 is a perspective view of the fixing device 1. For the sake of easy viewing of arrangement of the heat sensitive bodies 33, the fixing belt 10, the reinforcing member 36, the urging member 35, the covering member 34, and the heater holding member 32 are omitted in FIG. 8. The heat sensitive bodies 33 include first heat sensitive bodies 33C and second heat sensitive bodies 33D. Two first heat sensitive bodies 33C are arranged on the heater 31, for example. The first heat sensitive bodies 33C are thermistors, for example. Two second heat sensitive bodies 33D are arranged on the heater 31, for example. The second heat sensitive bodies 33D are thermal fuses, for example. The heat sensitive bodies 33 are arranged in a longitudinal direction of the heater 31. The urging member 35 and the covering member 34 are arranged for each of the heat sensitive bodies 33.

Embodiments of the present disclosure have been described so far with reference to the accompanying drawings. However, the present disclosure is not limited to the above-described embodiments and can be practiced in various ways within the scope without departing from the essence of the present disclosure. Elements of configuration disclosed in the above embodiments can be combined as appropriate in various different forms. For example, some of the elements of configuration may be omitted among all of the elements of configuration described in the embodiment. Alternatively or additionally, elements of configuration described in different embodiments may be combined as appropriate. The drawings are schematic illustrations that emphasize elements of configuration in order to facilitate understanding thereof, and the thickness, length, numbers, distance, and the like of each element of configuration illustrated in the drawings may differ from actual ones thereof in order to facilitate preparation of the drawings. The materials, shape, dimension, and so on of each element of configuration shown in the above-described embodiments are merely examples that do not impart any particular limitations and may be altered in various ways, so long as such alterations do not substantially deviate from the configuration of the present disclosure.

As described with reference to FIG. 2, the image forming apparatus 100 is a monochrome multifunction peripheral in the embodiments, which should not be taken to limit the present disclosure. The image forming apparatus 100 only need to be an electrographic image forming apparatus. For example, the image forming apparatus 100 may be a color multifunction peripheral.

What is claimed is:

1. A fixing device comprising:

a fixing belt;

a pressure member configured to apply pressure to the fixing belt while in contact with an outer circumferential surface of the fixing belt and rotate about a rotation axis of the pressure member; and a heating section disposed opposite to an inner circumferential surface of the fixing belt, wherein the heating section includes:

a heater that heats the fixing belt;

a heater holding member that holds the heater;

a heat sensitive body disposed on the heater holding member so as to be located opposite to the heater;

a covering member disposed opposite to the heater holding member with the heat sensitive body therebetween;

an urging member that is disposed between the covering member and the heat sensitive body and that urges the heat sensitive body in an urging direction from the heat sensitive body toward the heater;

a reinforcing member that extends in a direction parallel to the rotation axis of the pressure member and that reinforces the heater holding member; and a belt holding member that secures the reinforcing member and the heater holding member with the covering member therebetween, the heater holding member includes a first restricting portion and a second restricting portion, the first restricting portion and the second restricting portion are disposed with the urging member therebetween in a direction parallel to the rotation axis of the pressure member, each of the first restricting portion and the second restricting portion restricts movement of the covering member in a direction opposite to the urging direction, the covering member includes a first engaging portion and a second engaging portion, the first engaging portion engaging with the first restricting portion, the second engaging portion engaging with the second restricting portion, in an engagement state in which the first engaging portion and the second engaging portion respectively engage with the first restricting portion and the second restricting portion in a slidable manner in the urging direction, the urging member urges the heat sensitive body in the urging direction, and in a reinforcing member opposed state after transition from the engagement state, the urging member urges the heat sensitive body in the urging direction at a pressure larger than that in the engagement state, the reinforcing member opposed state being a state in which the reinforcing member is secured to the heater holding member with the belt holding member therebetween.

2. The fixing device according to claim 1, wherein the reinforcing member has a contact surface that is in contact with the urging member, and the contact surface is planar in shape.

3. The fixing device according to claim 1, wherein the covering member includes a protrusion protruding in the urging direction, the urging member is a coil spring, and the urging member is secured to the protrusion.

4. The fixing device according to claim 3, wherein the heater holding member has an opening, the opening has a shape corresponding to a shape of a bottom portion of the heat sensitive body, and the protrusion is disposed opposite to the heater with the urging member and the heat sensitive body therebetween in a state in which the bottom portion of the heat sensitive body is fitted in the opening.

5. The fixing device according to claim 1, wherein each of the first restricting portion and the second restricting portion of the heater holding member protrudes in an inverted L shape in cross section from the heater holding member, each of the first engaging portion and the second engaging portion of the covering member is in an L shape in cross section, and the first restricting portion is located opposite to the second restricting portion with the heat sensitive body therebetween.

6. The fixing device according to claim 1, wherein the heat sensitive body includes at least one of a thermal fuse, a thermostat, and a thermistor, the thermal fuse shuts off electric power supply to the heater when a temperature of the heater is equal to or higher than a first threshold, the thermostat shuts off the electric power supply to the heater when the temperature of the heater is equal to or higher than a second threshold, and causes the electric power supply to the heater to be resumed when the temperature of the heater becomes lower than the second threshold, and the thermistor measures the temperature of the heater.

7. An image forming apparatus comprising:

the fixing device according to claim 1; and an image forming section configured to form a toner image on a sheet, wherein the fixing device fixes the toner image to the sheet.

8. The fixing device according to claim 1, wherein the covering member includes a side wall extending in parallel to the rotation axis of the pressure member, the side wall being in contact with the reinforcing member in the reinforcing member opposed state.

9. The fixing device according to claim 8, wherein the side wall includes a first side wall and a second side wall disposed opposite to each other with the urging member therebetween.

10. The fixing device according to claim 1, wherein in the reinforcing member opposed state, engagement between the first engaging portion and the first restricting portion and engagement between the second engaging portion and the second restricting portion are released.

* * * * *